US012352118B1

(12) United States Patent
Alotaibi et al.

(10) Patent No.: US 12,352,118 B1
(45) Date of Patent: Jul. 8, 2025

(54) METHOD AND APPARATUS FOR DELIVERING AND SETTING A EUTECTIC ALLOY PLUG TO CURE LOSS-OF-CIRCULATION IN DRILLING APPLICATIONS

(71) Applicant: SAUDI ARABIAN OIL COMPANY, Dhahran (SA)

(72) Inventors: Msalli Alotaibi, Dammam (SA); Amjad Alshaarawi, Khobar (SA); Saeed Abdullah Al-Dossary, Khobar (SA)

(73) Assignee: SAUDI ARABIAN OIL COMPANY, Dhahran (SA)

( * ) Notice: Subject to any disclaimer, the term of this patent is extended or adjusted under 35 U.S.C. 154(b) by 0 days.

(21) Appl. No.: 18/408,861

(22) Filed: Jan. 10, 2024

(51) Int. Cl.
*E21B 21/00* (2006.01)
*E21B 33/13* (2006.01)
*E21B 33/136* (2006.01)

(52) U.S. Cl.
CPC ..... *E21B 21/003* (2013.01); *E21B 33/13* (2013.01); *E21B 33/136* (2013.01)

(58) Field of Classification Search
CPC ..... E21B 33/10; E21B 33/13; E21B 33/138; E21B 33/136; E21B 21/003
See application file for complete search history.

(56) References Cited

U.S. PATENT DOCUMENTS 1,834,434 A * 12/1931 Starr ..... E21B 33/136 166/195
3,011,548 A * 12/1961 Holt ..... E21B 27/02 166/162
11,174,701 B2 11/2021 Pearl, Jr. et al.
11,486,222 B2 11/2022 Shafer
2006/0144591 A1* 7/2006 Gonzalez ..... E21B 29/10 166/57
2008/0047708 A1* 2/2008 Spencer ..... E21B 33/138 166/60
2018/0094504 A1* 4/2018 Hearn ..... A01H 5/10
2018/0258735 A1 9/2018 Shafer
2018/0313193 A1 11/2018 Gibb
2020/0332620 A1 10/2020 Carragher
2021/0164321 A9 6/2021 Carragher et al.
2021/0222047 A1 7/2021 Pearl, Jr. et al.
2022/0025730 A1 1/2022 Carragher
2022/0307343 A1 9/2022 Hearn et al.
2022/0372833 A1* 11/2022 Hiorth ..... E21B 33/1204

FOREIGN PATENT DOCUMENTS

CA 2559226 A1 3/2008

OTHER PUBLICATIONS

Soheil Akbari and Hossein Kazemi, "Materials science application in plug and abandonment of oil and gas wells," Cerma, Feb. 2021, 7 pages.

* cited by examiner

*Primary Examiner* — Brad Harcourt
(74) *Attorney, Agent, or Firm* — Osha Bergman Watanabe & Burton LLP

(57) ABSTRACT

A downhole assembly is disclosed that includes a basket having a base, a connection end opposite the base, and a side extending between the base and the connection end. A heater extends centrally through the basket from the base, where the heater has an electrical connection at an end of the heater opposite the base. A volume of eutectic pellets is provided in the basket, and the downhole assembly is used to plug a downhole location by using the heater to melt the eutectic pellets at the downhole location.

19 Claims, 9 Drawing Sheets

METHOD AND APPARATUS FOR DELIVERING AND SETTING A EUTECTIC ALLOY PLUG TO CURE LOSS-OF-CIRCULATION IN DRILLING APPLICATIONS

BACKGROUND

In oil or gas well drilling, lost circulation or loss-of-circulation occurs when drilling fluid, known commonly as "mud," flows into one or more geological formations instead of returning up the annulus. Lost circulation can be a serious problem during the drilling of an oil well or gas well. For example, total lost returns may lead to reduction of the fluid column in the well and pressure exerted on the open formation. As a result, this might lead to a catastrophic loss of well control.

Lost circulation events may occur due to natural or induced fractures. Natural causes include encounters with naturally fractured or unconsolidated formations. Induced losses occur when the hydrostatic fluid pressure (the pressure exerted by the drilling mud on the walls of the well) exceeds the fracture gradient of the formation (the maximum pressure after which the formation breaks) and the formation pores breakdown enough to receive rather than resist the fluid. When lost circulation occurs, forward progress on well delivery is generally setback, and can often provoke new requirements of time, drilling fluids, and cement, and add substantially to the overall cost and time of a well.

The drilling industry has developed several techniques to fight losses, including, for example, the use of lost-circulation materials (LCM) to plug fractures, the use of chemicals, and the use of cement. Chemical methods and cementing are used in day-to-day drilling activities, but they are insufficient in some scenarios, especially in the case of total loss-of-circulation. In particular, as LCM or cement flows in the liquid phase to the loss zone, they end up drifting away deep into the fractures long before they solidify.

Another solution has been the use of metal expandable liners. With such technology, a solid metal liner is run-in-hole across the loss zone. This liner is then expanded against the walls of the well in order to seal the loss zone. In particular, these liners are expanded by pulling a cone with larger diameter through them. As the cone is pulled, the inner diameter of the liner expands to fit the cone. However, if any cuttings/formation breakage falls behind the expandable liner, the expansion process might fail. Additionally, there is a risk of drilling fluid continuing to leak from above and below the expandable liner. To resolve such issues, two additional packers may be installed at the top and bottom of the expandable liner in order to create a tight seal through which fluid flow is prevented. However, the use of packers is not guaranteed to work because the diameter of the well is typically irregular and larger than the used bit size due to wash outs, which makes it hard to ensure that the packers seal properly.

SUMMARY

This summary is provided to introduce a selection of concepts that are further described below in the detailed description. This summary is not intended to identify key or essential features of the claimed subject matter, nor is it intended to be used as an aid in limiting the scope of the claimed subject matter.

In one aspect, embodiments disclosed herein relate to downhole assemblies that include a basket having a base, a connection end opposite the base, and a side extending between the base and the connection end. A heater may be provided in the basket, extending centrally through the basket from the base, where the heater has an electrical connection at an end of the heater opposite the base.

In another aspect, embodiments disclosed herein relate to methods for sealing a section of a well. The methods may include providing a downhole plugging assembly connected to an end of a pipe string, where the downhole plugging assembly includes a basket having a base and a connection end at opposite axial ends of the basket and a side extending between the base and the connection end, wherein the basket is made of a eutectic alloy, and a heater extending centrally through the basket from the base, where the heater has an electrical connection at an end of the heater opposite the base. The methods may also include providing a volume of eutectic pellets into the basket, where the eutectic pellets are made of the eutectic alloy. For example, a volume of eutectic pellets may be dropped into the basket at a downhole location from a surface location, or the volume of eutectic pellets may be filled into the basket at a surface location. Methods disclosed herein further include running the downhole plugging assembly through the well to a downhole location, connecting the electrical connection of the heater to a power source, activating the heater to melt the volume of eutectic pellets and the basket to fill the downhole location with the melted eutectic alloy of the eutectic pellets and the basket, and allowing the melted eutectic alloy to cool to form a eutectic plug plugging the downhole location.

Other aspects and advantages of the claimed subject matter will be apparent from the following description and the appended claims.

BRIEF DESCRIPTION OF DRAWINGS

Specific embodiments of the disclosed technology will now be described in detail with reference to the accompanying figures. Like elements in the various figures may be denoted by like reference numerals for consistency. The size and relative positions of elements in the drawings are not necessarily drawn to scale. For example, the shapes of various elements and angles are not necessarily drawn to scale, and some of these elements may be arbitrarily enlarged and positioned to improve drawing legibility.

DETAILED DESCRIPTION

Figure 1:
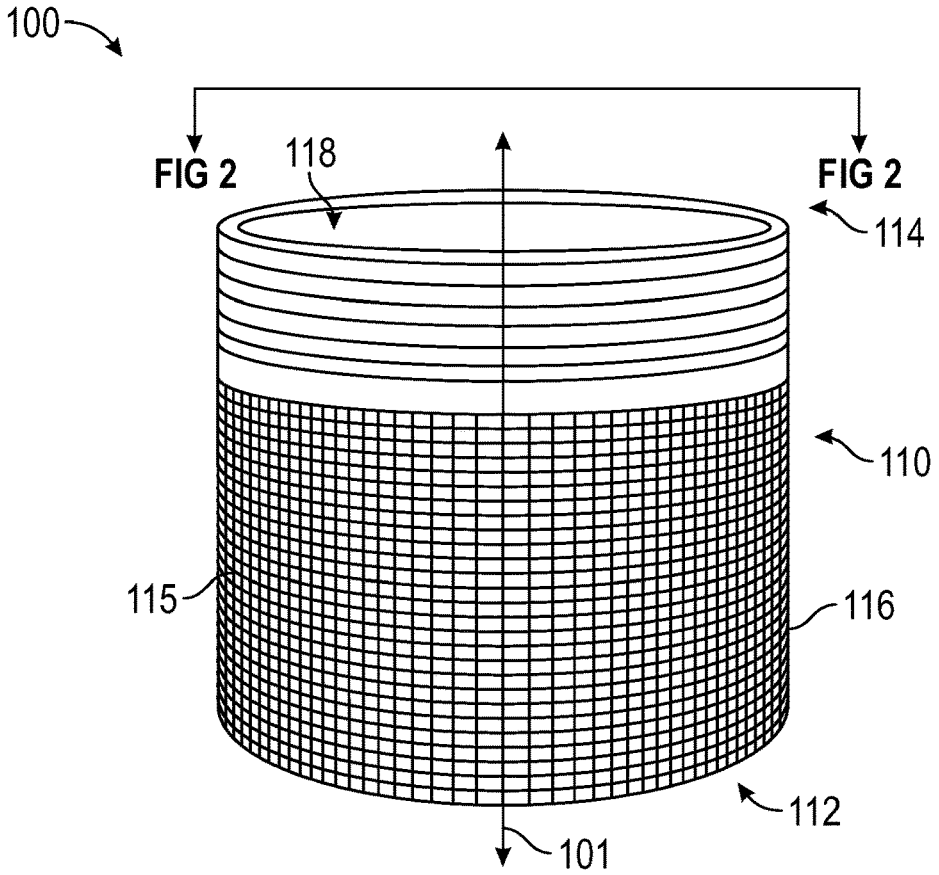
FIG. 1 is a side view of a downhole plugging assembly according to embodiments of the present disclosure.

In one aspect, embodiments disclosed herein relate to plugging a section of a well using pellets made of a eutectic alloy, referred to herein as eutectic pellets. A eutectic alloy is a mixture of two or more components (most commonly alloys) in a ratio at which the mixture melts at a lower temperature than the melting point of any one of the individual components. Eutectic alloys will melt and solidify at the same, single temperature (rather than over a temperature range), which is sometimes referred to as the eutectic point. Examples of eutectic alloys include bismuth-based alloys, such as alloys of bismuth and tin, or alloys of bismuth and germanium and/or copper.

According to embodiments of the present disclosure, eutectic pellets may be used to plug a section of a well at a selected downhole location by positioning a basket at the selected downhole location and filling the basket with a volume of eutectic pellets. The basket may be configured to hold the eutectic pellets at the downhole location without the eutectic pellets escaping into the surrounding formation. A heater may then be used to heat and melt the volume of eutectic pellets to a molten eutectic alloy. The basket is also configured to where the molten eutectic alloy is able to flow into the surrounding section of the well. In open hole (uncased) sections of a well, the molten eutectic alloy may flow into the surrounding formation. As soon as molten eutectic alloy cools to its eutectic point, the eutectic alloy resolidifies and forms a eutectic plug in the section of the well.

Eutectic pellets may be used to plug various types of well sections. For example, eutectic pellets may be used to plug a section of a well identified as having a loss zone. A loss zone may refer to a portion of the well in which fluid being circulated through the well is partially or totally lost through the loss zone into the formation. Loss of circulation is physically seen when the flow rate in the returns line drops below the flow rate in lines leaving the mud pumps into the well. The difference between the two lines may be used to quantify the loss severity. Thus, there are degrees of loss of circulation that may be identified in a well. For example, a total loss of circulation occurs when no return fluid reaches the surface following introduction of drilling fluid into the wellbore. A partial loss of circulation occurs when a predefined minimum amount of return fluid reaches the surface following introduction of drilling fluid into the wellbore. For example, a loss zone may be identified as a portion of the well in which fluid flows from the well into the formation at a rate of at least 10 bbls/hr.

By using assemblies and methods disclosed herein, where eutectic pellets are delivered to a selected downhole location in a basket, the eutectic pellets may be held in the basket in the selected downhole location without getting lost into the surrounding formation (e.g., in a loss zone) prior to being melted into a eutectic plug. Thus, the basket allows a volume of eutectic pellets to be accumulated in the selected downhole location in an amount capable of filling and plugging the selected section of the well. After the eutectic pellets are accumulated in the basket as a volume of eutectic pellets capable of filling and plugging the selected section of the well, the volume of eutectic pellets may be melted together to form the eutectic plug.

According to embodiments of the present disclosure, when a volume of eutectic pellets is provided in a basket in a selected downhole location, the eutectic pellets may be heated and melted using a heater provided downhole with the basket. For example, as described more below, a heater may be connected to a basket to provide a downhole plugging assembly, which may be sent downhole and used to hold and melt eutectic pellets for plugging the downhole location.

Figure 2:
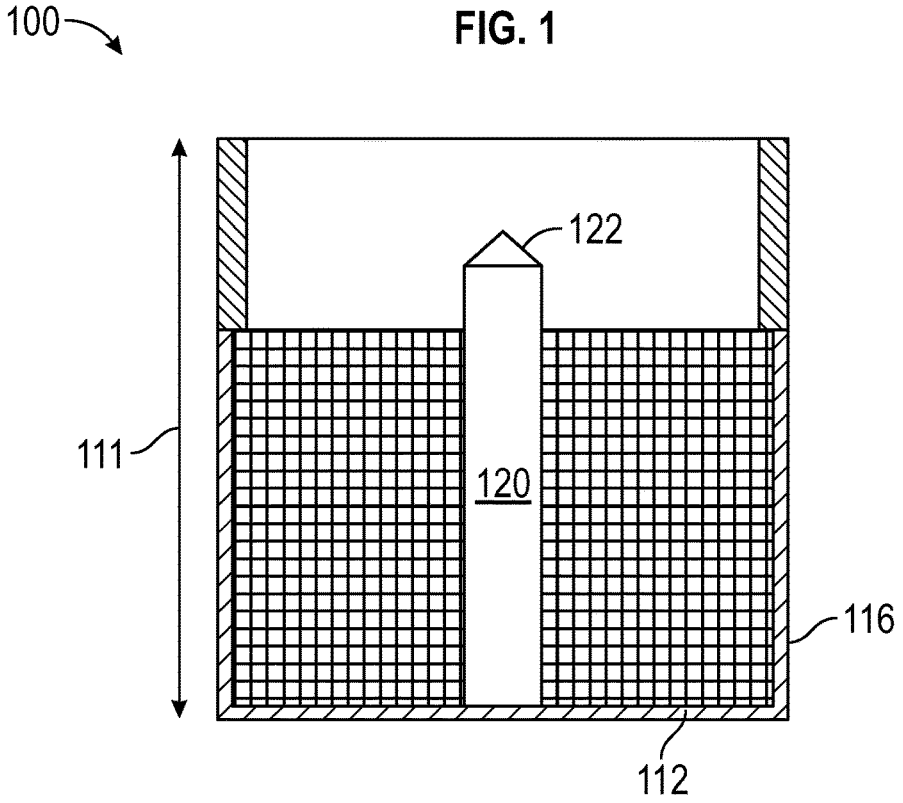
FIG. 2 shows a cross-sectional view along an axial plane of the downhole plugging assembly shown in FIG. 1.

An example of a downhole plugging assembly according to embodiments of the present disclosure is shown in FIGS. 1 and 2, where the downhole plugging assembly 100 includes a basket 110 configured to hold a volume of eutectic pellets. Particularly, FIG. 1 shows a side view of the assembly 100 and FIG. 2 shows a cross-sectional view of the assembly 100 along an axial plane extending through a central longitudinal axis 101. The basket 110 has a base 112, a connection end 114 opposite the base, and a side 116 extending between the base 112 and the connection end 114. Together, the base 112 and side 116 form a generally cylindrical shape, where the base 112 has a circular shape and the side 116 encircles the base, extending axially from the periphery of the base. However, other container shapes (having a base with one or more sides extending around its periphery) may be used to form a basket capable of holding a volume of eutectic pellets.

An opening 118 to the basket is formed at the connection end 114 of the basket, opposite the base, through which eutectic pellets may be filled into the basket. As such, the connection end of a basket may have a generally annular shape. The connection end of a basket may further include one or more connection features used to connect the basket to other components. For example, the connection end of a basket may have a threaded connection which may be used to threadably couple the basket to another component. In some embodiments, the connection end may include one or more slots (e.g., J-slots) or one or more interlocking features, which may be used interlock with a corresponding interlocking feature of another component (e.g., a running tool). In the embodiment shown in FIGS. 1 and 2, the connection end 114 has a threaded outer surface. The threaded outer surface may be threadably connected to a pipe string (or an intermediate component connected to the pipe string) used to lower the connected basket to the downhole location.

According to embodiments of the present disclosure, the connection end of a basket may have a relatively thicker wall than the side and/or base of the basket. A relatively thicker wall forming a connection end may be needed, for example, for selected connection feature requirements (e.g., minimum thread size).

The downhole plugging assembly 100 further includes a heater 120 extending centrally through the basket 110 from the base 112. The heater 120 may be fixed to the base 112, for example, by a threaded connection, other mechanical attachment, or welding. In the embodiment shown, the heater 120 is a thermite heater having a body of thermite material and an electrical connection 122 at an end of the heater opposite the base. Thermite material forming a thermite heater may be a fuel/oxidizer mixture in the solid phase. The heater 120 further includes an electric igniter in contact with the thermite body, where the electric igniter may be electrically connected to a power source via the electrical connection 122.

Various types of heaters may be envisioned for use in a downhole plugging assembly according to embodiments of the present disclosure, where the heater may include an electrical connection for electrically activating the heater (e.g., via a wireline connection to a power source at the surface of the well). Thermite heaters are well suited due to their high reaction temperature and thermal output and because thermite contains its own supply of oxygen, which allows ignition in low-oxygen environments. Additionally, the molten products resulting from the thermite reaction of a thermal heater after ignition (e.g., slag) may remain in the downhole location of the reaction and when cooled, form a small part of the eutectic plug.

As discussed in more detail below, eutectic pellets may be filled into the basket 110 around the heater 120, where the heater 120 may melt the eutectic pellets into a volume of molten eutectic material. According to embodiments of the present disclosure, the basket of a downhole plugging assembly may be configured to allow the molten eutectic material to flow into the surrounding environment (e.g., into a downhole location to plug a section of a well). The basket may be configured to both contain eutectic pellets and allow escape of the molten eutectic material (from melting the eutectic pellets) by having perforated walls and/or by being made of the same eutectic alloy as the eutectic pellets being contained and then melted.

For example, referring again to FIGS. 1 and 2, the base 112 and the side 116 of the basket 110 may be made of a eutectic alloy. In some embodiments, the base and side of a basket may be made of the same eutectic alloy that forms the eutectic pellets that will be used to fill the basket. By forming the eutectic pellets and basket of the same eutectic alloy, the heater may melt both the eutectic pellets and basket together into molten eutectic material that flows into the surrounding environment to plug a section of a well. The connection end 114 may also be made of the same eutectic alloy as the base 112 and side 116, or the connection end 114 may be made of a non-eutectic alloy. For example, the connection end of a basket may be made of a different alloy having a melting temperature higher than the eutectic alloy forming the rest of the basket. By forming the connection end of a basket with a non-eutectic alloy, it may remain intact/solid when the heater melts the eutectic pellets and/or basket, thereby allowing it to be removed with a connected pipe string after the plugging process.

In some embodiments, the basket may be made of a non-eutectic material. In such embodiments, the basket may be made of a millable material so that the basket may be milled together with the eutectic plug formed by the eutectic pellets at the end of the plugging operation.

Additionally, in the embodiment shown, the basket 110 has a plurality of holes 115 formed through the walls of the base 112 and side 116. The holes 115 may range in size and shape and may be formed in a pattern or in randomized positions around the basket 110. In some embodiments, the holes 115 are the spaces within a mesh (e.g., a wire mesh of eutectic material) forming walls of the basket 110. In some embodiments, holes are perforations formed through an otherwise solid wall. The holes may all have the same size or may be differently sized, where the largest hole size may be less than an average size of eutectic pellets used to fill the basket. For example, in one or more embodiments, eutectic pellets may have an average diameter ranging from 2-3 mm, and the basket holding the eutectic pellets may have walls with about 15 pores per inch (ppi) or more.

By having holes formed through basket walls made of a eutectic alloy, the basket walls may be formed with a relatively less amount of material than would otherwise be used with solid walls, and thus may melt together with eutectic pellets contained therein at a relatively faster rate. By having holes formed through basket walls made of a non-eutectic alloy, melted eutectic pellets may be allowed to flow out of the basket, through the holes, and into the surrounding environment to form a well plug. Further, by having holes formed through basket walls, the holes may allow drilling fluid to pass therethrough (but are sized to prevent the pellets from flowing therethrough), such that a circulation path for drilling fluid may be maintained as the basket is lowered to a downhole location.

In some embodiments, a basket may be formed with one or more solid walls (no holes) of a eutectic alloy. For example, a basket base, alone, may be a solid wall of eutectic alloy, a basket side, alone, may be a solid wall of eutectic alloy, or the entire basket may be made of solid walls of eutectic alloy. In such embodiments, at least one flow path may be provided through the basket and/or above the basket (e.g., through a connection sub between the basket and the drill string carrying the basket). The one or more flow paths may be designed to maintain a circulation path for drilling fluid to circulate through the assembly while running the assembly downhole.

In embodiments having a basket formed with one or more or all solid walls of eutectic alloy, the downhole plugging assembly may be designed to heat and melt the basket walls with eutectic pellets filling the basket using a single heating step, such that the eutectic alloy of the basket and pellets melt together. For example, such downhole plugging assembly design may include the use of multiple heaters (to generate sufficient heat to melt both the basket walls and pellets), the use of a thicker or larger heater (or other heater capable of generating more heat output), and/or the use of thin basket walls.

Downhole plugging assemblies according to embodiments of the present disclosure may be designed to plug different sizes of well sections. For example, downhole plugging assemblies used to plug a section of a well having a diameter ranging from 8-12 inches may have baskets with a correspondingly wider diameter (e.g., ranging from 6-10 inches) than baskets in downhole plugging assemblies used to plug a section of a smaller well having a diameter ranging from 4-8 inches. According to embodiments of the present disclosure, a downhole plugging assembly may have a maximum outer diameter ranging, for example, from about 80% to 90% of the well diameter in which the downhole plugging assembly is to be used.

Additionally, a basket in a downhole plugging assembly may have different axial lengths. For example, when a relatively larger section of well needs to be plugged, and thus a relatively larger volume of eutectic pellets is needed to plug the selected well section, a basket having a relatively longer axial length may be used to hold the larger volume of eutectic pellets at the selected well section. According to embodiments of the present disclosure, a basket 110 may have an axial length 111 measured in the axial direction from the base 112 to the opposite end of the basket, which may range, for example, from 30 to 40 feet.

In some embodiments, one or more basket extensions may be connected to a basket in an end-to-end fashion at their connection ends to provide a downhole plugging assembly having a greater total axial length. Multiple basket joints may be connected together at their axial ends, for example, by welding, using threaded connections, or by other connection methods. In downhole plugging assemblies having multiple basket joints, a heater may be designed to extend through each basket joint.

Figure 3:
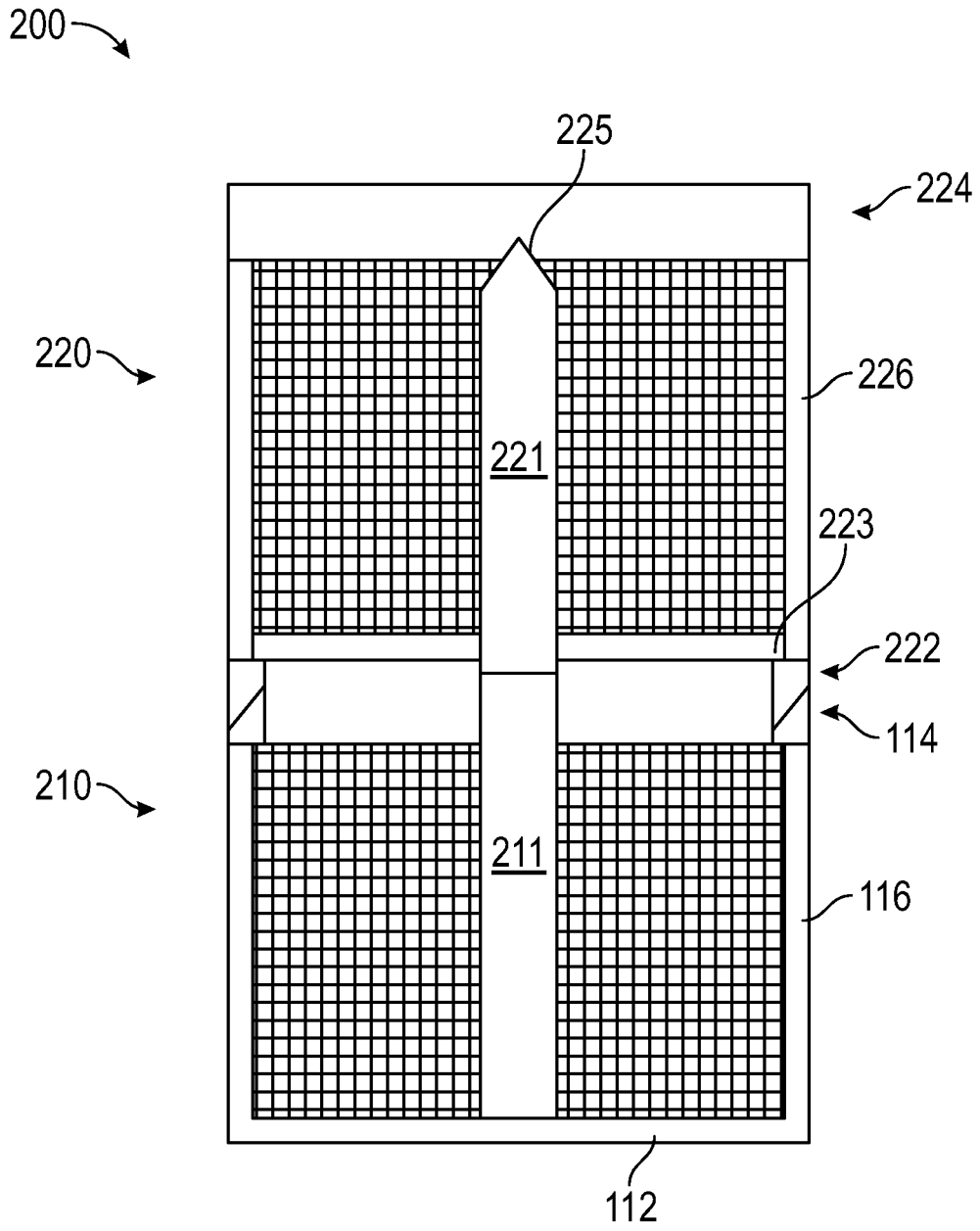
FIG. 3 shows a cross-sectional view along an axial plane of a downhole plugging assembly according to embodiments of the present disclosure.

For example, FIG. 3 shows a cross-sectional view along an axial plane of a downhole plugging assembly 200 according to embodiments of the present disclosure having multiple basket joints (basket 210 and basket extension 220) connected together in an end-to-end fashion. The basket 210 includes a base 112, a connection end 114 opposite the base, and a side 116 extending around the periphery of the base and axially between the base and connection end. A first heater 211 is connected to the base 112 of the basket 210 and extends axially through the basket to the connection end 114.

The basket extension 220 includes extension connections at opposite axial ends of the basket extension 220 and a side extension 226 extending between the extension connections. The extension connections may be of the same type at each axial end, or different types (e.g., a weld at one axial end and a threaded connection at the opposite axial end). For example, in the embodiment shown in FIG. 3, a first extension connection 222 at a first axial end and a second extension connection 224 at a second, opposite axial end are both threaded connections. The first extension connection 222 is threadably connected to the connection end 114 of the basket 210.

Additionally, a second heater 221 is held inside the basket extension 220 using one or more supports 223. In the embodiment shown, the supports 223 are positioned at the first axial end and act like a base holding the second heater 221 in position. The second heater 221 is held in a central location aligning with the first heater 211 and in an axial position proximate to or adjacent to an end of the first heater 211. As such, the first and second heaters 211, 221 are in an axially stacked configuration extending axially through the entire downhole plugging assembly 200. The second heater 221 also includes an electrical connection 225 at an opposite end from the first heater 211. The axially stacked configuration allows for ignition from the electrical connection 225 at the second heater 221 to generate heat from both the first and second heaters axially through the entire assembly 200. For example, when axially stacked heaters are thermite heaters, the uppermost thermite heater may include an electrical connection and ignition, and ignition of the uppermost thermite heater heats and ignites the axially adjacent thermite heater.

Support(s) used to hold a heater within a basket extension may be made of a eutectic alloy. By using a eutectic alloy to form support(s) holding a heater within the basket extension, the support(s) may be melted by heat from the heater and used to form a eutectic plug along with eutectic pellets.

According to embodiments of the present disclosure, the side extension of a basket extension may be made of the same material and structure as the side 116 of the basket 210. For example, the side extension of a basket extension may be made of a eutectic alloy and/or may have holes formed therein.

In some embodiments, connection ends of basket joints (e.g., the first and/or second extension connections 222, 224) may be formed of a eutectic alloy. In embodiments having one or more connection ends formed of a eutectic alloy, the eutectic alloy connection ends may melt when the eutectic pellets are melted.

The embodiment shown in FIG. 3 shows one basket extension connected to a basket to extend the axial length of the downhole plugging assembly. However, in one or more embodiments, more than one basket extension may be connected to a basket in an axial end-to-end fashion. Thus, according to embodiments of the present disclosure, the connection end of a basket may be connected to a pipe string via at least one basket extension.

Downhole plugging assemblies according to embodiments of the present disclosure may be used in various methods that include plugging a section of a well. For example, according to embodiments of the present disclosure, a method using a downhole plugging assembly may include connecting the assembly to an end of a pipe string to run the assembly through a well to a downhole location, dropping a volume of eutectic pellets into the basket of the assembly at the downhole location, connecting the heater of the assembly to a power source via a wireline, activating the heater to melt the volume of eutectic pellets and the basket to fill the downhole location with molten eutectic alloy from the eutectic pellets and the basket, and allowing the molten eutectic alloy to cool to form a eutectic plug plugging the downhole location. A section of a well may be plugged with eutectic alloy from a downhole plugging assembly according to embodiments of the present disclosure, for example, to plug a loss zone in the well.

For example, FIGS. 4-8 show an example of a method using a downhole plugging assembly according to embodiments of the present disclosure to seal a section of a well. Methods described below may be useful for sealing sections of a vertical or slightly deviated well.

Figure 4:
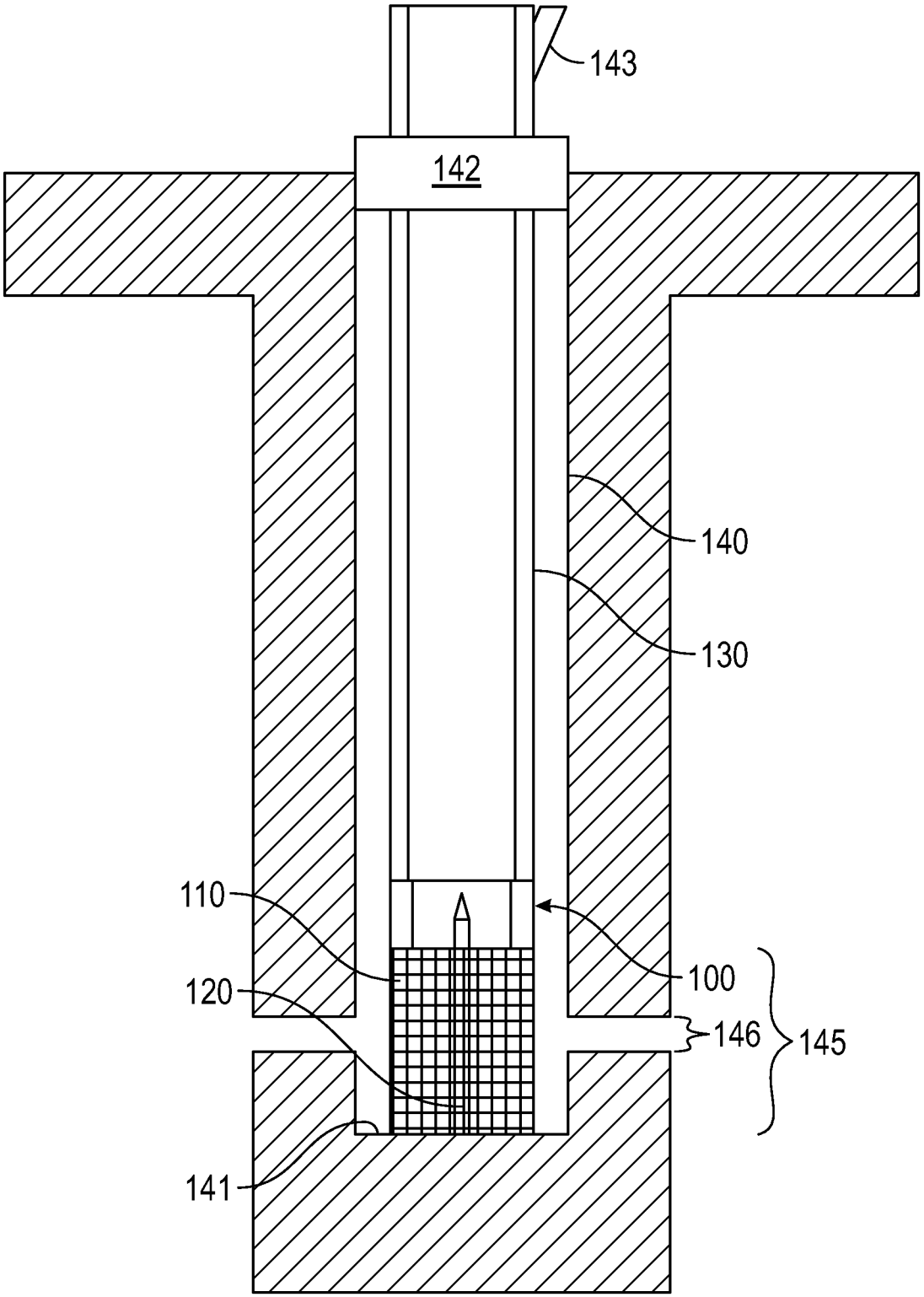
FIG. 4 shows a well system provided with a downhole plugging assembly according to embodiments of the present disclosure.

Referring to FIG. 4, a method for sealing a section of a well may include providing a downhole plugging assembly 100 connected to an end of a pipe string 130 (e.g., a string of drill pipe or coiled tubing), where the downhole plugging assembly 100 includes a basket 110 and a heater 120 extending centrally through the basket 110. The downhole plugging assembly 100 may be run through the well 140 to a downhole location 145. During run-in, the pipe string 130 extends through the well 140 from wellhead equipment 142 located at an opening to the well. Other known supporting equipment (not shown) may be located at the surface of the well to run-in the pipe string and connected well equipment and to operate the sealing operation. When the downhole plugging assembly 100 is sent to the selected downhole location 145, a side-entry sub 143 may be connected to an upper end of the pipe string 130. The side-entry sub may provide downhole access to the downhole plugging assembly, as described more below.

In the embodiment shown, the downhole location 145 is at a bottom end of the well 140. In such embodiments, the downhole plugging assembly 100 may be run in hole until the assembly contacts a bottom surface 141 of the well 140. Additionally, according to embodiments of the present disclosure, the downhole location 145 may include a loss zone 146. For example, the downhole plugging assembly may be sent to a downhole location having a loss zone causing a total loss of circulation.

Figure 5:
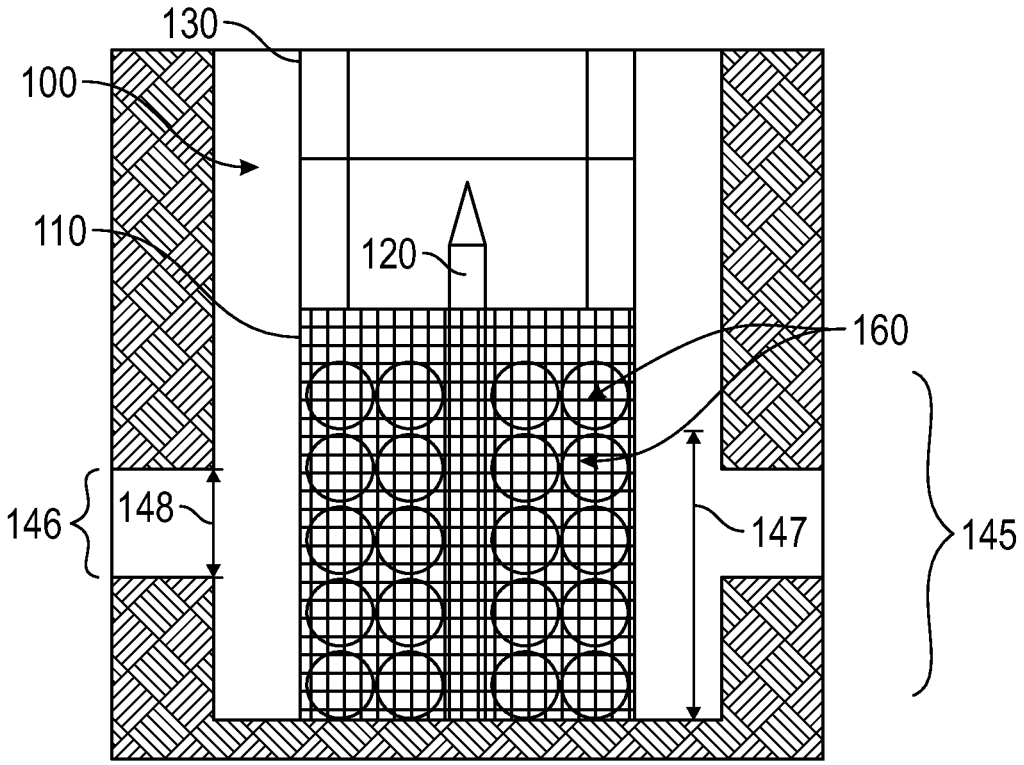
FIG. 5 shows a step of filling a basket with eutectic pellets in methods according to embodiments of the present disclosure.

Referring now to FIG. 5, FIG. 5 shows a zoomed in view of the downhole plugging assembly 100 in the downhole location 145. When the downhole plugging assembly 100 is positioned at the downhole location 145, a volume of eutectic pellets 160 is dropped into the basket 110, around the heater 120, at the downhole location. The volume of eutectic pellets 160 may be dropped into the basket 110 by delivering the eutectic pellets from the surface of the well, through the pipe string 130, to the connected downhole plugging assembly 100.

In one or more embodiments, rather than delivering eutectic pellets 160 from the surface through the pipe string 130 to the basket 110 after the downhole plugging assembly 100 is positioned at a selected downhole location 145, eutectic pellets 160 may be packed into a basket prior to sending the basket downhole. In such embodiments, a selected volume of eutectic pellets may be filled into a downhole plugging assembly, and the downhole plugging assembly may be connected to an end of a pipe string. The connected, filled, downhole plugging assembly may then be lowered to a downhole location. In one or more embodiments, when eutectic pellets are filled into a basket at the surface, prior to sending the filled downhole plugging assembly to a downhole location, a lid may be provided to cover the volume of eutectic pellets in the basket. For example, a lid may be positioned in an axial position along a basket side that is axially between the eutectic pellets and the connection end of the basket. In one or more embodiments, a lid may be fitted around the heater provided in the downhole plugging assembly. In such embodiments, the lid may aid in holding the heater in an upright position through the basket as the downhole plugging assembly is lowered to a downhole location.

A lid may have holes formed therethrough (e.g., to allow drilling fluid to circulate through), or the lid may be a solid wall (e.g., where one or more flow paths may be provided above the lid such as on a drill pipe connection sub to allow drilling fluid to circulate as the assembly is lowered downhole). Additionally, a lid may be made of eutectic or non-eutectic material.

As discussed above, the eutectic pellets 160 may be made of a eutectic alloy. According to embodiments of the present disclosure, the eutectic pellets may be made of the same eutectic alloy used to form the basket 110 of the downhole plugging assembly 100. Additionally, eutectic pellets may have various shapes, including for example, generally spherical-shaped beads, irregular shaped pieces, or other shapes. Eutectic pellets may also have different sizes. For example, eutectic pellets may have an average diameter ranging from a lower limit selected from 1 mm, 2 mm, or 3 mm to an upper limit selected from 3 mm, 5 mm, 10 mm, or more, for example, depending on the manufacturing process used to make the pellets. For example, in some embodiments, eutectic pellets may be manufactured by pouring molten eutectic metal into a large quantity of water or other liquid, from which surface tension would then break the liquid metal into small spheres. Using such techniques, eutectic pellets may have an average diameter of between 2-3 mm. In embodiments using a basket with holes formed throughout the basket walls, the eutectic pellets may have an average diameter greater than an opening size of the basket holes. As such, the basket may be capable of containing the eutectic pellets while they are in pellet form (prior to melting the eutectic pellets).

The volume of eutectic pellets sent to the downhole location 145 to be contained in the downhole plugging assembly basket 110 may be selected to fill a well section volume in the downhole location when melted. For example, prior to sending a volume of eutectic pellets 160 to a downhole location, a well section volume in the downhole location may be estimated. A well section volume may be estimated, for example, by multiplying the cross-sectional area of the well at the downhole location (xx (radius of the well) 2) by the axial length 147 of the well section in the downhole location 145 being plugged. Further, depending on the size and shape of the eutectic pellets 160 being used, a volume of eutectic pellets (including the spaces between the pellets) may decrease to different molten eutectic material volumes when melted. Thus, selecting the volume of eutectic pellets to send downhole may also include estimating the volume reduction from melting the volume of eutectic pellets to form the molten eutectic material volume. According to embodiments of the present disclosure, a volume of eutectic pellets may be selected, for example, as an amount ranging from 1.5 to 2.5 times the estimated well section volume to be filled. A volume of eutectic pellets that results in an excess amount of eutectic material for the plug may be acceptable, as the excess volume may be milled away with the plug.

In some embodiments, estimation of a well section volume may further include adding a loss factor to account for additional well volume that may need filling to plug a loss zone 146. In such cases, the estimated volume of eutectic pellets may be increased by a loss factor proportional to an estimated size of the loss zone. For example, the size of a loss zone may be estimated based on an estimated opening area 148 (the area of the opening to the loss zone fracture(s)), and the loss factor may be selected as being, for example, 1 to 1.5 times the estimated size of the loss zone. For example, in some embodiments, the size of a loss zone may be estimated from the amount of loss detected at the surface of the well. In one or more embodiments, an estimated volume of eutectic pellets may be estimated based on a "modified" diameter of the wellbore location being plugged, where the modified diameter may be modified by an estimated depth of penetration into the formation. For example, an estimated penetration of a few inches into the formation may result in a modified diameter of the wellbore diameter plus a few inches. By accounting for a loss factor in the volume of eutectic pellets sent to a downhole location, the volume of eutectic pellets may be designed to have enough eutectic material to flow partially into the loss zone when melted. As the molten eutectic alloy flows into the loss zone, the eutectic alloy cools. Once the molten eutectic alloy cools to its eutectic temperature, the eutectic alloy resolidifies to seal the loss zone.

According to embodiments of the present disclosure, after a selected volume of eutectic pellets are delivered into a downhole plugging assembly, the heater in the downhole plugging assembly may be connected to a power source at the surface of the well via a wireline. In alternative embodiments, a heater in a downhole plugging assembly may be connected to a downhole power source (e.g., located at an end of the pipe string carrying the downhole plugging assembly) and triggered through a timer. In some embodiments, a heater in a downhole plugging assembly may be connected to a downhole power source and triggered by communication through pressure pulses.

Figure 6:
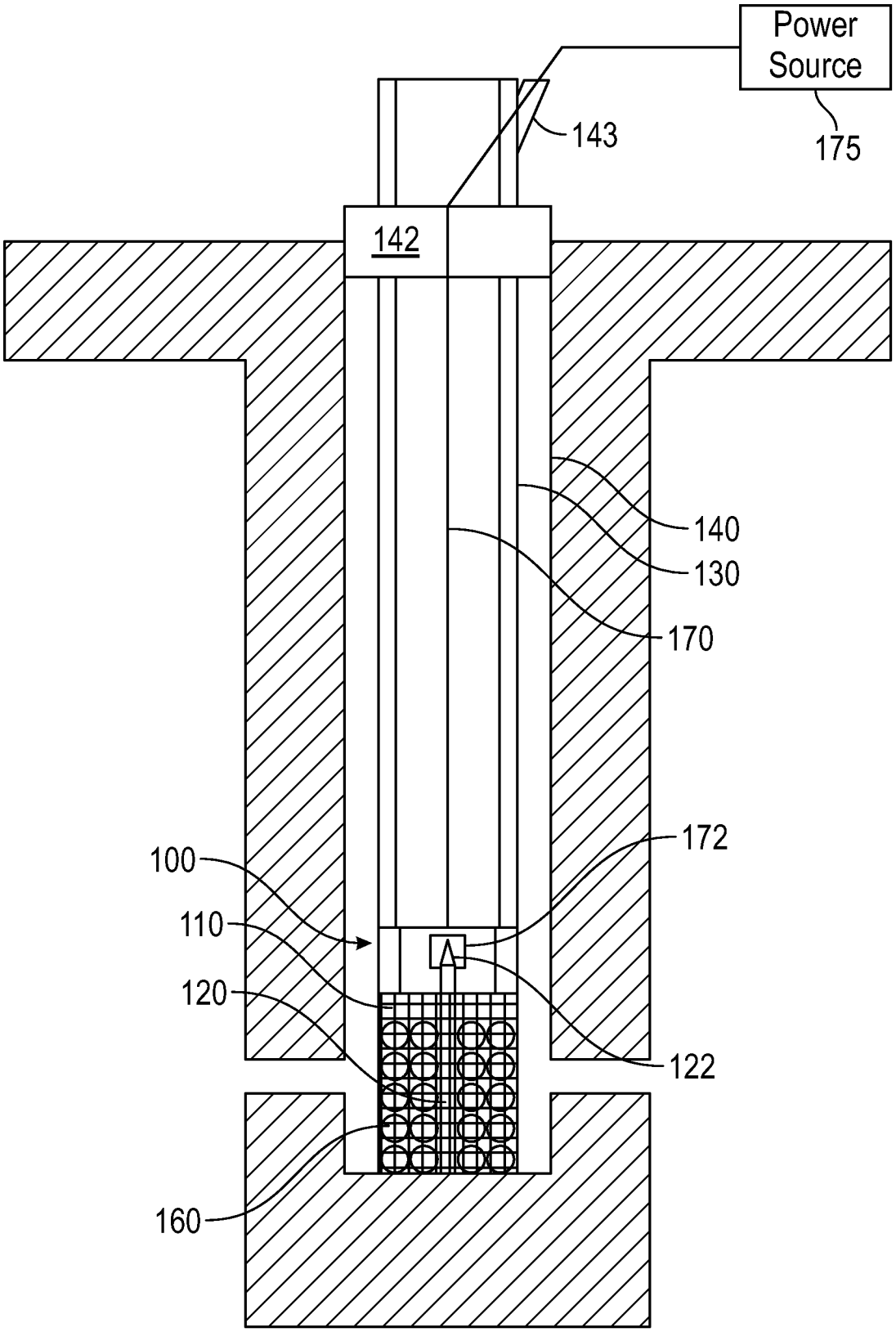
FIG. 6 shows a step of providing power to a downhole plugging assembly in methods according to embodiments of the present disclosure.

For example, as shown in FIG. 6, after the volume of eutectic pellets 160 are delivered to the downhole plugging assembly 100, an electrical connection 122 at an end of the heater 120 is connected to a power source 175 via a wireline 170. The wireline 170 is run from the surface, through the side-entry sub 143, to the downhole plugging assembly 100 to provide power to the assembly. The wireline 170 includes a wireline plug 172 provided at its end. The wireline plug 172 may have a size and shape that corresponds with the electrical connection 122 on the heater 120. Additionally, the wireline plug may include electrically conducting outer surfaces, which may act as electrical connection points when contacted to corresponding electrical connection points in the heater electrical connection.

According to embodiments of the present disclosure, the wireline plug 172 may be sent downhole via wireline 170 until the wireline plug 172 lands on the heater electrical connection 122. Various types of guides (e.g., passages, sensors, magnets, or others) may be used to guide the wireline plug 172 to connect to the heater electrical connection 122. Once the wireline 170 is electrically connected to the heater 120 via the wireline plug 172, an operator may turn on the heater 120 to melt the eutectic pellets 160.

When the heater 120 is activated, the heater 120 melts any eutectic alloy forming the assembly, including the volume of eutectic pellets. For example, when eutectic alloy is used to form both the eutectic pellets and the basket of the downhole plugging assembly, the heater melts the eutectic pellets and the basket to fill the downhole location with the molten eutectic alloy of the eutectic pellets and the basket.

Figure 7:
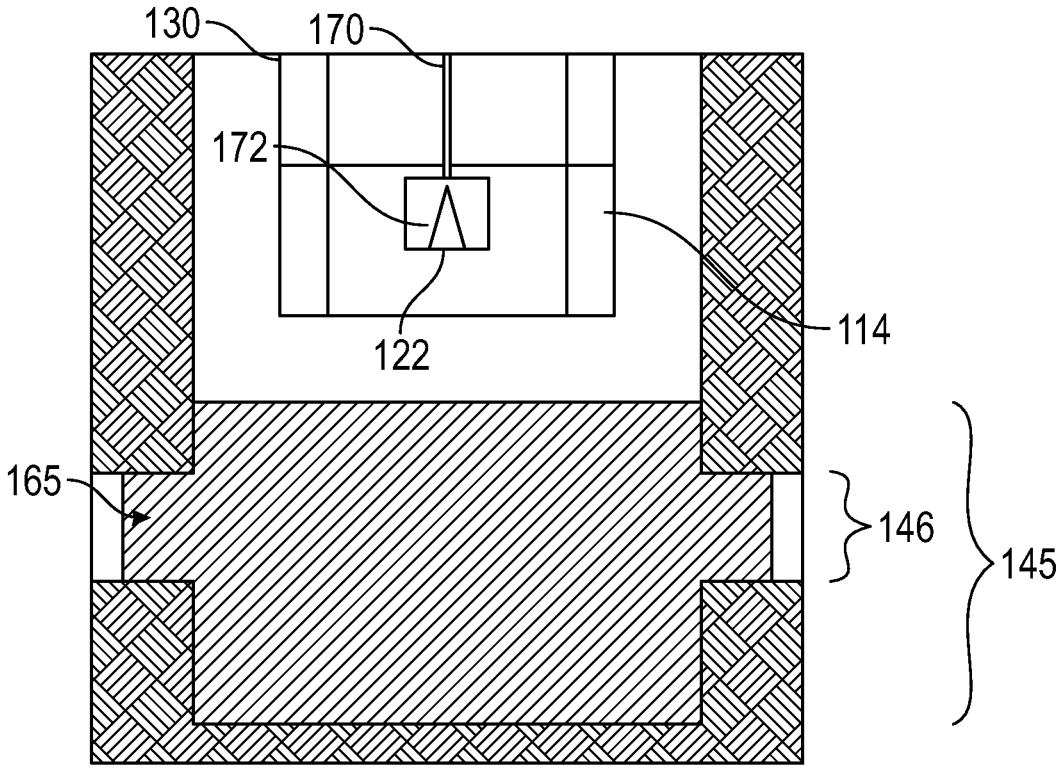
FIG. 7 shows a step of melting eutectic alloy in a downhole plugging assembly in methods according to embodiments of the present disclosure.

Referring now to FIG. 7, FIG. 7 shows a zoomed in view of the well system shown in FIG. 6 at the downhole location 145, where the heater 120 is activated to heat and melt eutectic alloy of the eutectic pellets and of a portion of the basket containing the eutectic pellets. In the embodiment shown, the connection end 114 of the basket is formed of an alloy having a melting temperature greater than the eutectic alloy and remains un-melted during the heating step.

When the eutectic alloy of the downhole plugging assembly is melted, the formed molten eutectic alloy is able to flow and fill the well section volume in the downhole location 145, including any openings to the loss zone 146 at the downhole location 145. The molten eutectic alloy is then allowed to cool in the downhole location to form a eutectic plug 165 plugging the downhole location 145, including the loss zone 146. Additionally, in the embodiment shown, the heater was a thermite heater, where the molten thermite reaction products of the heater are able to flow with the molten eutectic alloy. Thus, after the melting step, the connection end 114 of the basket and the electrical connection 122 of the heater are the only components remaining from the downhole plugging assembly still connected to well equipment, where the connection end 114 remains connected to the pipe string 130 and the heater electrical connection 122 remains connected to the wireline plug 172.

After the eutectic plug 165 is formed in the downhole location 145, the pipe string 130 and the wireline 170 may be pulled out of the well, leaving the eutectic plug 165 in the well.

According to embodiments of the present disclosure, after a eutectic plug is formed in a well, the eutectic plug may be milled through to continue drilling the well. For example, a eutectic plug may be used to seal loss zones around the well wall to allow for effective continued drilling.

Figure 8:
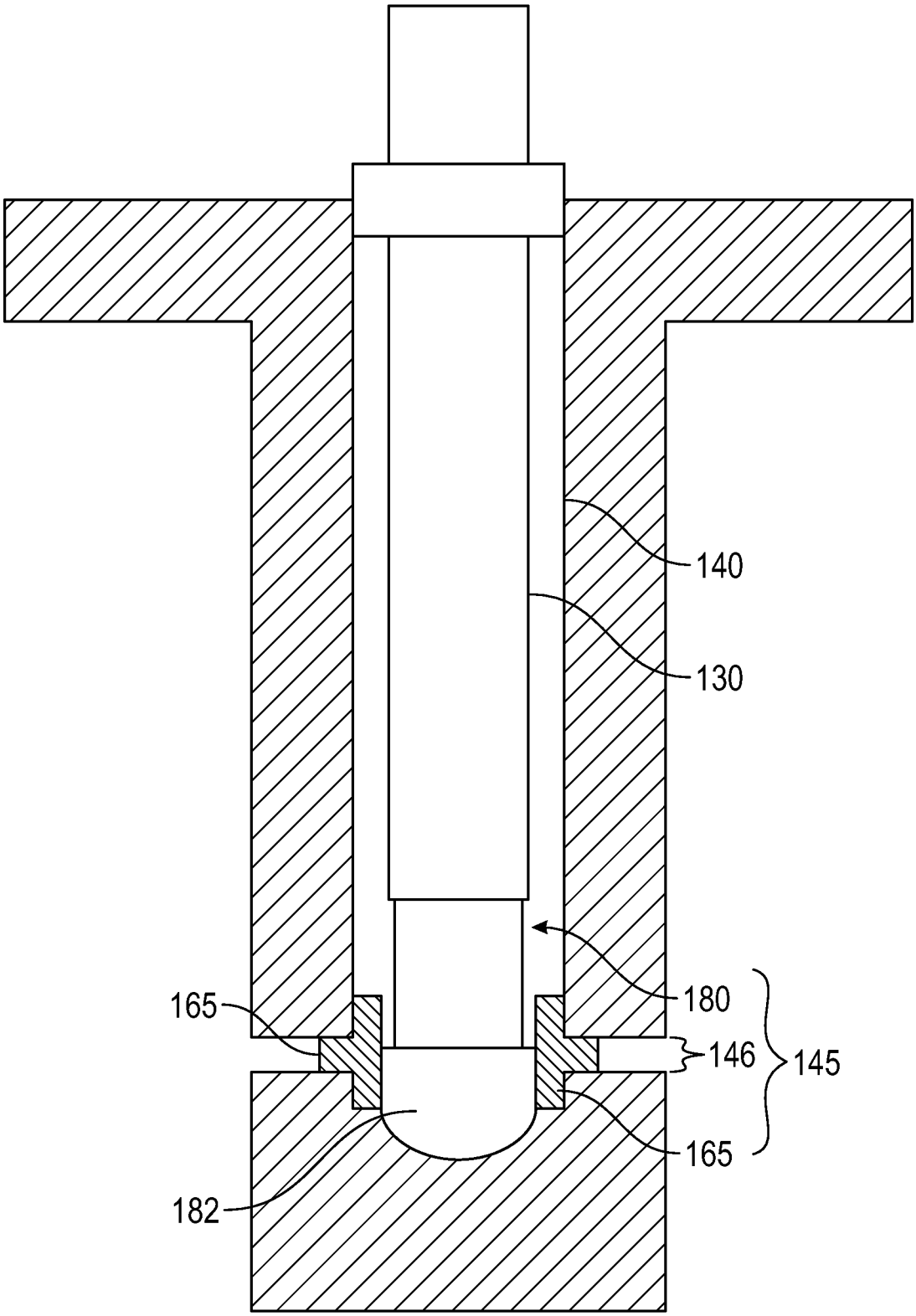
FIG. 8 shows a step of milling a eutectic plug in methods according to embodiments of the present disclosure.

Referring now to FIG. 8, FIG. 8 shows the well system of FIG. 7, where the eutectic plug 165 is milled through using a milling assembly 180. As shown, after the eutectic plug 165 is formed in the downhole location 145 to plug the loss zone 146, a milling assembly 180 is run into the well 140 on a pipe string, which may or may not be the same pipe string 130 used to run in the downhole plugging assembly. The milling assembly 180 includes a mill 182, which is designed to grind away metal downhole (e.g., using tungsten carbide cutting surfaces). After the mill 182 mills entirely through the length of the eutectic plug 165, the mill assembly 180 may be removed from the well 140.

Figure 9:
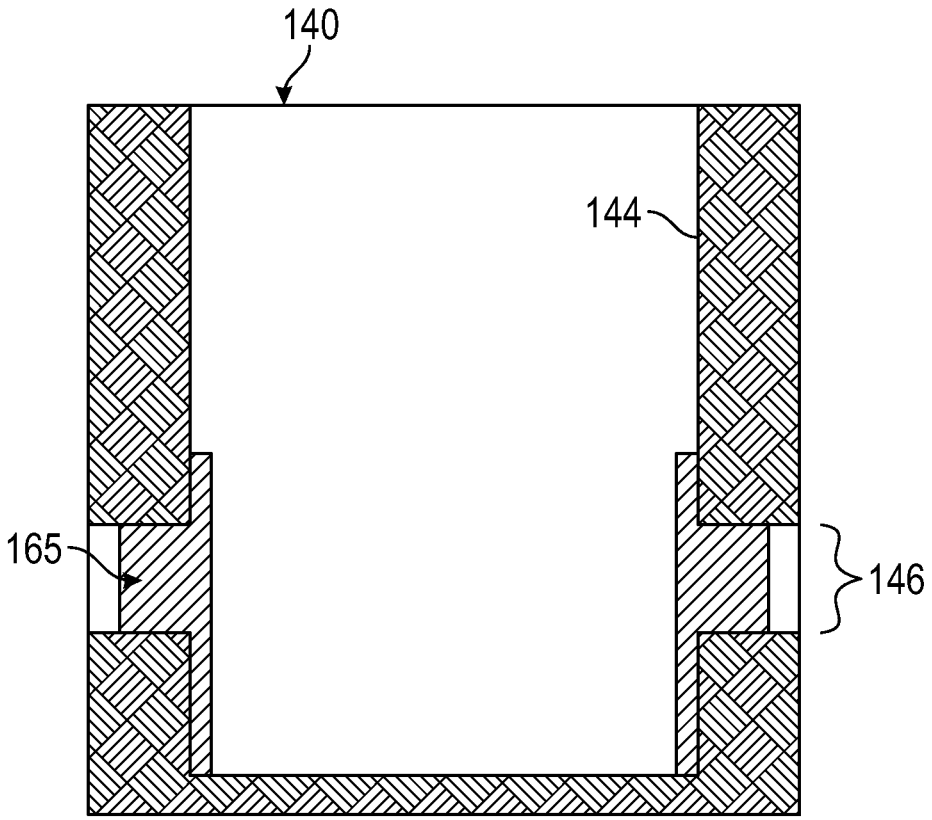
FIG. 9 shows a section of a well sealed using a downhole plugging assembly according to embodiments of the present disclosure.

As shown in FIG. 9, after the mill 182 mills through the eutectic plug 165, portions of the eutectic plug 165 remain around the perimeter of the well wall 144 and partially filling the fractures of the loss zone 146 thereby sealing the loss zone 146 from the well 140. Drilling through the well may then continue past the eutectic plug 165 (e.g., using a bottom hole assembly including a drill bit run in hole on a drill string).

The methods shown in FIGS. 4-9 show use of a downhole plugging assembly 100 according to embodiments of the present disclosure to plug a downhole location 145 at the bottom of a well 140. However, methods described herein may also be used to plug an uphole portion of a well. In such embodiments, a millable plug may be set at a lower limit of a selected downhole location to be plugged, where the millable plug may act as an artificial bottom of the well. As an artificial bottom, the millable plug may be used to contain molten eutectic alloy from a downhole pluggable assembly before it resolidifies into a eutectic plug.

Figure 10:
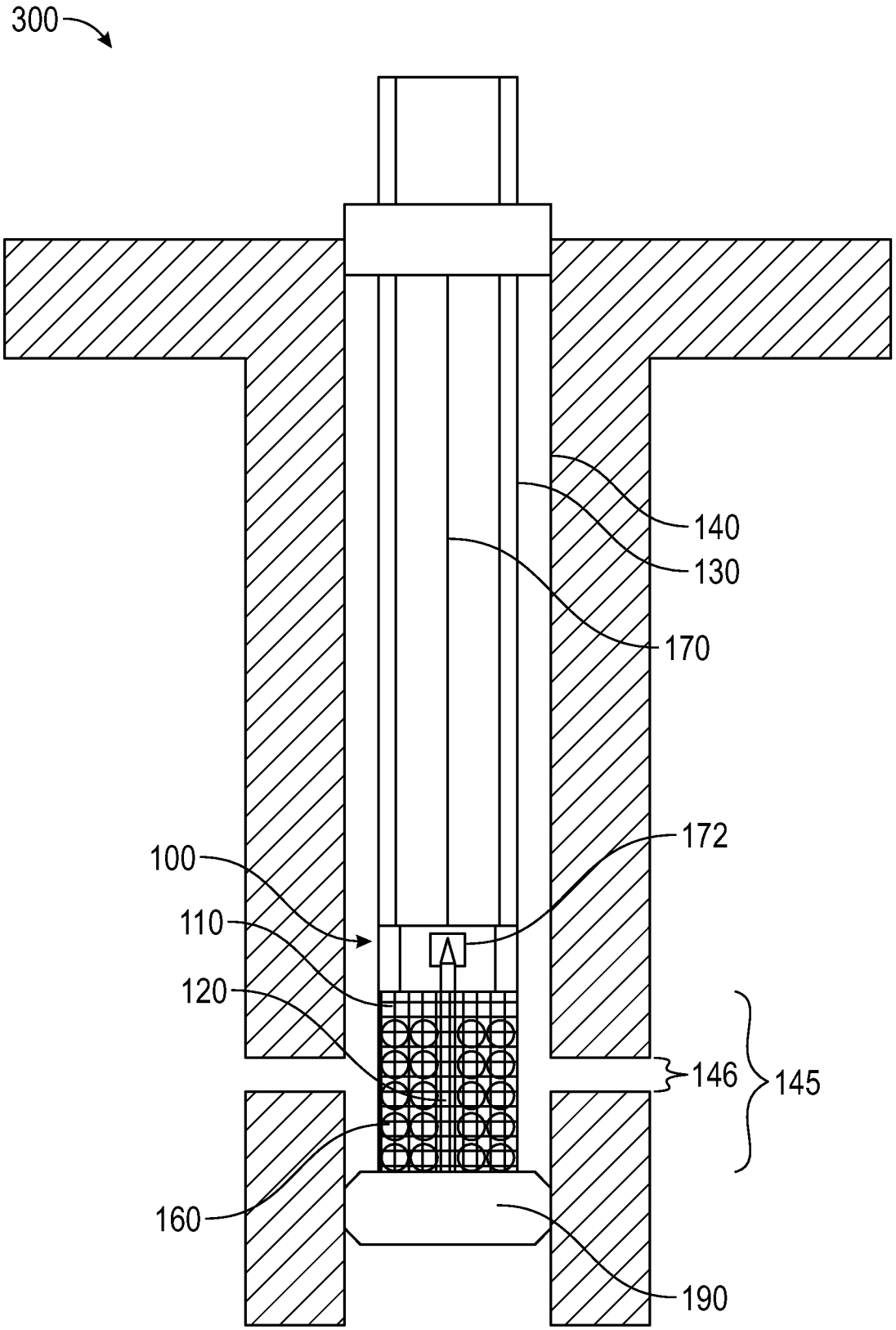
FIG. 10 shows a well system provided with a downhole plugging assembly according to embodiments of the present disclosure.

For example, referring to FIG. 10, FIG. 10 shows an example of a well system 300 having a loss zone 146 identified at a downhole location 145 above the bottom of the well 140. In well system 300, a millable plug 180 is set (e.g., using wireline, coiled tubing, or other pipe string) at a lower axial end of a selected downhole location 145. The millable plug may be selected from any type of millable plug known in the art and may include a radially expandable body made of millable material (e.g., aluminum, elastomers, etc.). A downhole plugging assembly 100 according to embodiments of the present disclosure is then run to the downhole location 145 to position the basket 110 on the millable plug 190. As described above, eutectic pellets 160 are provided in the basket 110, and a heater 120 may be activated (e.g., via a wireline 170 and wireline plug 172 connection) to melt the eutectic pellets 160. The molten eutectic alloy from the heated downhole plugging assembly 100 may then fill the surrounding well section volume over the millable plug 190 at the downhole location 145. As the molten eutectic alloy fills the surrounding well section, the molten eutectic alloy may plug the loss zone 146. The molten eutectic alloy may then cool to form a eutectic plug on the millable plug 190.

According to embodiments of the present disclosure, after the eutectic plug is formed over the millable plug 190, the pipe string 130, the wireline 170, and any remaining non-melted components of the connected downhole plugging assembly 100 may be removed from the well 140. A milling assembly may then be run into the well 140 to mill through the eutectic plug and the millable plug 190. After milling through the eutectic plug and the millable plug, well operations may continue (e.g., drilling).

By using a downhole pluggable assembly according to embodiments of the present disclosure to form a eutectic plug in a downhole location of a well, the eutectic material may be delivered to the downhole location without being lost in the well. Additionally, by delivering the eutectic material to the downhole location in the form of pellets around a heater in the downhole pluggable assembly, the eutectic material may be more easily melted into molten eutectic alloy to fill the downhole location. The molten eutectic alloy may then cool to resolidify and form a eutectic plug. Advantageously, eutectic alloys expand upon resolidifying, which may act as a better plug when compared with other non-eutectic metals that shrink upon resolidifying.

Although only a few example embodiments have been described in detail above, those skilled in the art will readily appreciate that many modifications are possible in the example embodiments without materially departing from this invention. Accordingly, all such modifications are intended to be included within the scope of this disclosure as defined in the following claims.

What is claimed:

1. A downhole assembly, comprising:

a basket, comprising:

a base;

a connection end opposite the base; and a side extending between the base and the connection end; and a heater extending centrally through the basket from the base, the heater comprising an electrical connection at an end of the heater opposite the base, wherein the base and the side are made of a eutectic alloy.

2. The downhole assembly of claim 1, wherein the basket further comprises a plurality of holes formed through the base and side.

3. The downhole assembly of claim 2, further comprising a volume of eutectic pellets disposed inside the basket and around the heater, wherein the eutectic pellets have an average diameter greater than an opening size of the plurality of holes.

4. The downhole assembly of claim 1, wherein the connection end comprises a threaded connection.

5. The downhole assembly of claim 1, wherein the basket has an opening at the connection end, opposite the base.

6. The downhole assembly of claim 1, further comprising a basket extension connected to the basket at the connection end.

7. The downhole assembly of claim 1, wherein the basket has an axial length ranging from 30 to 40 feet.

8. The downhole assembly of claim 1, wherein the heater is a thermite heater comprising a body of thermite material.

9. A method for sealing a section of a well, comprising:

providing a downhole plugging assembly connected to an end of a pipe string, the downhole plugging assembly comprising:

a basket, comprising:

a base and a connection end at opposite axial ends of the basket; and a side extending between the base and the connection end, wherein the basket is made of a eutectic alloy;

a heater extending centrally through the basket from the base, the heater comprising an electrical connection at an end of the heater opposite the base;

running the downhole plugging assembly through the well to a downhole location;

dropping a volume of eutectic pellets into the basket at the downhole location, wherein the eutectic pellets are made of the eutectic alloy;

connecting the electrical connection of the heater to a power source via a wireline;

activating the heater to melt the volume of eutectic pellets and the basket to fill the downhole location with the melted eutectic alloy of the eutectic pellets and the basket; and allowing the melted eutectic alloy to cool to form a eutectic plug plugging the downhole location.

10. The method of claim 9, wherein the connection end of the basket is connected to the pipe string via at least one basket extension, each basket extension comprising:

extension connections at opposite axial ends of the basket extension; and a side extension extending between the extension connections, wherein the side extension is made of the eutectic alloy.

11. The method of claim 9, wherein the connection end of the basket is formed of an alloy having a melting temperature higher than the eutectic material, and wherein when the eutectic material is melted, the connection end of the basket remains connected to the pipe string.

12. The method of claim 9, wherein the downhole location is a bottom end of the well.

13. The method of claim 9, wherein prior to running the downhole plugging assembly to the downhole location, the method further comprises:

setting a millable plug at an axial end of the downhole location distal from a surface of the well, wherein when the downhole plugging assembly is run to the downhole location, the basket is positioned on the millable plug.

14. The method of claim 13, wherein after the eutectic plug is formed, the method further comprises:

pulling the pipe string and the wireline out of the well; and running a milling assembly into the well to mill through the eutectic plug and the millable plug.

15. The method of claim 9, wherein the heater is a thermite heater comprising a body of thermite material, and wherein activating the heater comprises igniting the body of thermite material.

16. The method of claim 9, further comprising:

pulling the pipe string and the wireline out of the well; and running a milling assembly into the well to mill through the eutectic plug.

17. The method of claim 9, wherein the basket further comprises a plurality of holes formed through the base and the side, wherein the volume of eutectic pellets has an average diameter greater than an opening size of the plurality of holes.

18. A method for sealing a section of a well, comprising:

providing a downhole plugging assembly connected to an end of a pipe string, the downhole plugging assembly comprising:

a basket, comprising:

a base and a connection end at opposite axial ends of the basket; and a side extending between the base and the connection end, wherein the basket is made of a eutectic alloy;

a heater extending centrally through the basket from the base, the heater comprising an electrical connection at an end of the heater opposite the base;

providing a volume of eutectic pellets into the basket, wherein the eutectic pellets are made of the eutectic alloy;

running the downhole plugging assembly through the well to a downhole location;

connecting the electrical connection of the heater to a power source;

activating the heater to melt the volume of eutectic pellets and the basket to fill the downhole location with the melted eutectic alloy of the eutectic pellets and the basket; and allowing the melted eutectic alloy to cool to form a eutectic plug plugging the downhole location.

19. The method of claim 18, wherein the volume of eutectic pellets is filled into the basket prior to running the downhole plugging assembly to the downhole location.

* * * * *